US006346010B1

(12) United States Patent
Emplit

(10) Patent No.: US 6,346,010 B1
(45) Date of Patent: Feb. 12, 2002

(54) MODULAR CONNECTOR

(75) Inventor: Raymond H. Emplit, Glen Mills, PA (US)

(73) Assignee: The Wiremold Company, West Hartford, CT (US)

( * ) Notice: Subject to any disclaimer, the term of this patent is extended or adjusted under 35 U.S.C. 154(b) by 0 days.

(21) Appl. No.: 09/661,242

(22) Filed: Sep. 13, 2000

Related U.S. Application Data

(60) Provisional application No. 60/224,149, filed on Aug. 10, 2000.

(51) Int. Cl.[7] ..... H01R 13/66; H01R 33/945

(52) U.S. Cl. ..... 439/620; 439/676; 439/941

(58) Field of Search ..... 439/620, 941, 439/676

(56) References Cited

U.S. PATENT DOCUMENTS

| | | | | |
|---|---|---|---|---|
| 4,457,570 A | | 7/1984 | Boaese, II | |
| 4,934,961 A | | 6/1990 | Piorunneck et al. | |
| 4,996,766 A | | 3/1991 | Piorunneck et al. | |
| 5,024,609 A | | 6/1991 | Piorunneck | |
| 5,040,991 A | | 8/1991 | Collier | |
| 5,186,647 A | | 2/1993 | Denkmann et al. | |
| 5,259,768 A | | 11/1993 | Brunker et al. | |
| 5,269,707 A | | 12/1993 | Reichardt et al. | |
| 5,282,754 A | | 2/1994 | Kish et al. | |
| 5,295,869 A | | 3/1994 | Siemon et al. | |
| 5,299,956 A | | 4/1994 | Brownell et al. | |
| 5,310,363 A | | 5/1994 | Brownell et al. | |
| 5,328,390 A | | 7/1994 | Johnston et al. | |
| 5,397,250 A | * | 3/1995 | Briones | 439/620 |
| 5,599,208 A | * | 2/1997 | Ward | 439/620 |
| 5,599,209 A | | 2/1997 | Belopolsky | |
| 5,639,266 A | | 6/1997 | Patel | |
| 5,791,942 A | | 8/1998 | Patel | |
| 6,139,371 A | * | 10/2000 | Troutman et al. | 439/676 |

* cited by examiner

*Primary Examiner*—Renee Luebke
*Assistant Examiner*—Felix O. Figueroa
(74) *Attorney, Agent, or Firm*—McCormick, Paulding & Huber LLP

(57) ABSTRACT

A modular connector has a body defining an opening to receive a telephone type jack. The conductors are arranged in pairs so that adjacent conductors of non-pairs create capacitive and inductive cross talk. The conductors are non-parallel in-part to provide inductive coupling that reduces cross talk. The free ends of the conductors are connected to capacitive layers of a substrate located behind the contact portions to reduce capacitive cross talk.

35 Claims, 9 Drawing Sheets

MODULAR CONNECTOR

CROSS REFERENCE TO RELATED APPLICATION

This application claims priority under 35 U.S.C. §119(e) to a prior co-pending provisional patent application Ser. No. 60/224,149, filed Aug. 10, 2000.

FIELD OF THE INVENTION

This invention relates to electrical connectors, and more particularly, to an improved modular connector for use in data communications and/or telephony.

BACKGROUND OF THE INVENTION

Modular connectors, such as the popular RJ 45 connector, are well known in the communications art. FIGS. 1A and 1B show a typical male modular connector 12, known as the "plug", and typical female modular connector 14, known as the "jack". The plug 12 and the jack 14 connectors mate for communicating signals between the external circuit 16, in this instance a printed circuit board, and the external circuit 18, in this instance a computer. The pins 20 of the jack 14 electrically connect to the printed circuit board, and the cable 22 electrically connects the plug 12 to the computer.

FIG. 1B shows a perspective view of the plug connector 12 and a partially cut away view of the jack connector 14. The plug connector 12 includes a body 24, and disposed with the body 24 are a plurality of conductors 28 that include blade-type contacts 30. The jack connector 14 can include the body 32, which in turn can include a housing 34 and a lead frame 36. The plurality of conductors 38 is disposed with the body 32, and each of the conductors of the plurality include a contacting portion for contacting the contacts 30 of the plug connector 12 when the plug connector 12 is mated with the jack connector 14. The reference numeral 40 indicates generally the row of contact portions of the plurality of connectors 38. The lead frame 36 of the body 32 can be included with the body 32 to space and support the plurality of conductors 38 such that contact portions thereof properly electrically connect with the contacts 30 of the plurality of conductors 28 of the plug connector 12, when the connections are mated.

Although the plug 12 and jack 14 above are each shown with eight conductors, one example of a modular connector, which can use only four conductors, is the ubiquitous telephone jack present in almost every home. Typically, however, the plug 12 and jack 14 will each include eight conductors, as shown in FIG. 1B, yielding four data conductor pairs.

The general mechanical design of the modular plug and jack connectors shown FIGS. 1A and 1B was determined at a time when the connectors were to be used almost exclusively for the transmission of relatively low frequency signals, such as analog telephone signals. At the present time, however, modular connectors are used at higher and higher frequencies, such as in computer networks. Unfortunately, at these higher frequencies, cross talk between data pairs of conductors becomes increasingly problematic. It is considered that certain aspects of the mechanical design of the typical modular connector contribute to causing the undesired cross talk.

For example, the conductors 28 of the plug connector 12 are very close and run parallel to each other, such that data conductors that should ideally be electromagnetically isolated from one another actually do interact. Cross talk can be categorized as capacitive, wherein the electric field of conductor of one data pair induces a voltage in a conductor of a different data pair, and inductive, wherein the magnetic field of a conductor of one data pair induces a current in a conductor of a different data pair.

The cross talk in modular connections is often further categorized as near-end cross talk, or NEXT, and far-end cross talk, or FEXT. NEXT refers to cross talk that appears as an unwanted signal in one data pair at, for example, the end 42 of plug connector 12, and is responsive to a signal also entering the end 42 of the plug on another data pair. Such cross talk can be launched onto the external circuit to which the plug connector 12 is electrically connected, such as the computer in FIG. 1A. Similarly, FEXT refers to cross talk that travels through the plug-jack mated pair. For example, for a desired signal entering the end 42 of the plug connector 12 on one data pair, FEXT refers to an undesired signal appearing at the pins 20 and on a different pair of conductors.

Cross talk becomes progressively worse as the frequency of the electrical signals increases. Cross talk standards are promulgated from time to time. Each new standard is typically stricter than the last, such as by increasing the frequency range and/or lowering the amount of allowable cross talk. For example, the Category 5 standard now in use specifies NEXT up to approximately 100 MHz. The Category 5 standard does not address FEXT. The new Category 6 standard specifies cross talk up to a frequency of 250 MHz. Furthermore, the Category 6 standard specifies limits for both NEXT and FEXT.

Because of the large installed base of older modular connectors, and the need for new connector designs to be backwardly compatible with such older connectors installed in the field, the mechanical arrangement of modular connectors is now standard and subject to little change. Accordingly, design choices can be limited, and the focus is on compensating for the cross talk introduced in the connectors. For example, designers have attempted to meet the Category 5 standard by introducing compensating electronic elements into the external circuits to which the plug and jack are connected, or into the jack and/or plug connectors. These elements typically compensate for the cross talk induced in the plug. For example, the conductors of a jack connector can be arranged to introduce inductive cross talk that cancels cross talk introduced in the plug. Also, it is known to provide capacitors on the external circuit 16, such as the printed circuit board of FIG. 1B, to which the output of the jack connector is electrically connected to compensate for cross talk introduced by the plug connector. While such techniques have been useful at lower frequencies, they are not entirely satisfactory, even in the upper frequency range of Category 5. The Category 6 specification significantly exceeds the 100 MHz limit of Category 5 to 250 MHz.

There is an additional complication. Designers are wary to attack the problem of cross talk in the Category 6 frequency range by attacking the source, that is by reducing the cross talk introduced in the plug connector, even apart from the general consideration that much of the mechanical design is fixed. This is because many Category 5 jacks in use meet the Category 5 specification by compensating for a known amount of cross talk in the plug. Remove that cross talk, and the "solution", that is, the compensation in the Category 5 jack, or in the external circuitry associated with the jack, simply becomes the "problem", and introduces cross talk when such a jack is mated with a newer plug that introduces less cross talk or that includes it own compensation.

Reducing the cross talk in modular connectors, particularly at higher frequencies, such as above the 100 MHz upper limit of the Category 5 specification, can be problematic.

Accordingly, it is an object of the present invention to address one or more of the foregoing disadvantages and drawbacks of the prior art.

It is another object of the present invention to provide an improved modular connector, such as a modular connector having improved cross talk performance.

SUMMARY OF THE INVENTION

In one aspect, the invention provides an improved modular connector such as a jack connector, for mating with another modular connector, such as a plug connector, for electrical connection therewith. The modular connector includes a body and a plurality of conductors disposed with the body. Each of the conductors extends from a first portion to a second end and has a contact portion therebetween, and the contact portions can be substantially parallel and arranged in a row for electrical connection with a row of contacts of the other connector when mated with the modular connector of the invention. The first portions are for connection with an external circuit for communication of signals between the contacts and the external circuit, and are electrically spaced from the contact portions. A capacitive element is disposed with the modular connector and is in electrical communication with a first pair of the conductors, where the electrical communication is established nearer electrically to the contact portions of the conductors than the first portions are to the contact portions.

Preferably, the electrical communication is established at less than about 5 degrees of phase of the contact portions at a selected frequency, such as the highest frequency at which cross talk is to reduced. More preferably, the electrical communication is established at less than about 3 degrees of phase of the contact portions. The selected frequency can be 200 MHz, or alternatively, 250 MHz.

In another aspect of the invention, there is provided a modular connector, such as a jack connector, for mating with a second modular connector of the opposite sex, such as a plug connector, where the second modular connector introduces cross talk having, a predetermined inductive component and a predetermined capacitive component. The modular connector includes a body and a plurality of conductors disposed with the body. Each of the conductors extends from a first portion to a second end and has a contact portion therebetween. The contact portions are substantially parallel and arranged in a row for electrical connection with a row of contacts of the second connector when the modular connector is mated with the second connector. The first portions are for connection with an external circuit for communication of signals between the contacts and the external circuit. Disposed with the connector are a capacitive element and an inductive element. The capacitive and inductive elements are in electrical communication with a first pair of the conductors. The capacitive element provides a capacitive compensation selected to address substantially only the capacitive component of the cross talk, and the inductive element provides an inductive coupling selected to address substantially only the inductive component of the cross talk. Apportioning the compensation in this manner can advantageously help reduce both NEXT and FEXT.

In yet a further aspect of the invention, there is provided a modular connector, such as a jack connector, for mating with a second modular connector of the opposite sex, such as a plug connector, for electrical connection therewith, and where the second modular connector introduces a undesirable cross talk. The modular connector of the invention includes a body and a plurality of conductors disposed with the body, where each of the conductors extends from a first portion to a second end and has a contact portion therebetween. The contact portions are substantially parallel and arranged in a row for electrical connection with a row of contacts of the second connector when the modular connector is mated with the second connector, and the first portions are for connection with an external circuit for communication of signals between the contacts and the external circuit. A capacitive element and an inductive element are both disposed with the connector. The capacitive and inductive elements are in electrical communication with a first pair of the conductors, and the inductive element is not interposed electrically between the capacitive element and the contact portions of the first pair of conductors.

The invention can also include methods than can be practiced in accordance with the teachings herein. For example, in yet an additional feature of the invention, there is provided a method of compensating for cross talk that occurs when a first modular connector mates with a second modular connector that includes a plurality of data pairs and that introduces cross talk between the data pairs. The method includes the following steps:

1) providing the first connector, where first connector includes a plurality of data pairs of conductors, each of the conductors having a contact portion for electrically contacting with a conductor of the other connector when the connectors are mated. Each of the conductors of the first connector extends from a first portion to a second end, with the contact portion being located between the first portion and the second end. The first portions are for connection with an external circuit for communication of signals between the contact portions and the external circuit, and have a predetermined electrical spacing from the contact portions; and
2) disposing a capacitive element with the first connector and in electrical communication with a first pair of the conductors, the pair not being a data pair, and the electrical communication being established nearer electrically to the contact portions of first pair of conductors than the first portions of the first pair of conductors are to the contact portions of the first pair of conductors.

In another aspect of the invention, there is provided a method for compensating for cross talk using a first modular connector when the first modular conductor is mated with a second modular connector that includes a plurality if pairs of data conductors and that introduces cross talk, having a predetermined capacitive component and a predetermined inductive component, between the data pairs. The method can include the steps of:

1) providing a capacitive element that provides a capacitive coupling selected to address substantially only the capacitive component of the cross talk;
2) providing an inductive element that provides an inductive coupling selected to address substantially only the inductive component of the cross talk; and
3) disposing the capacitive and inductive elements with the connector such that each is in electrical communication with a first pair of the conductors, the first pair being other than one of the data pairs.

In yet a further additional feature of the invention, the invention provides a method of compensating for cross talk in modular connector having a plurality of data conductor pairs, where each conductor has a contact portion for contacting; a conductor of the other connector when the connectors are mated. The method can include the steps of:

1) providing a capacitive element;

2) providing an inductive element; and 3) disposing the capacitive and inductive elements with the first connector such that each is in electrical communication with a first pair of the conductors, and such that the inductive element is not interposed electrically between the capacitive element and the contact portions of the conductors of the first pair.

Other features of the invention will be apparent from the present disclosure, including the following Brief Description of The Drawings and Detailed Description Of the Preferred Embodiments.

BRIEF DESCRIPTION OF THE DRAWINGS

For a more complete understanding of the invention, reference is made to the following Detailed Description Of The Preferred Embodiments, and the accompanying drawings, in which.

DETAILED DESCRIPTION OF THE PREFERRED EMBODIMENTS

According to the invention, the following discussion is provided in furtherance of an understanding of the creation and reduction of cross talk.

Figure 1A:
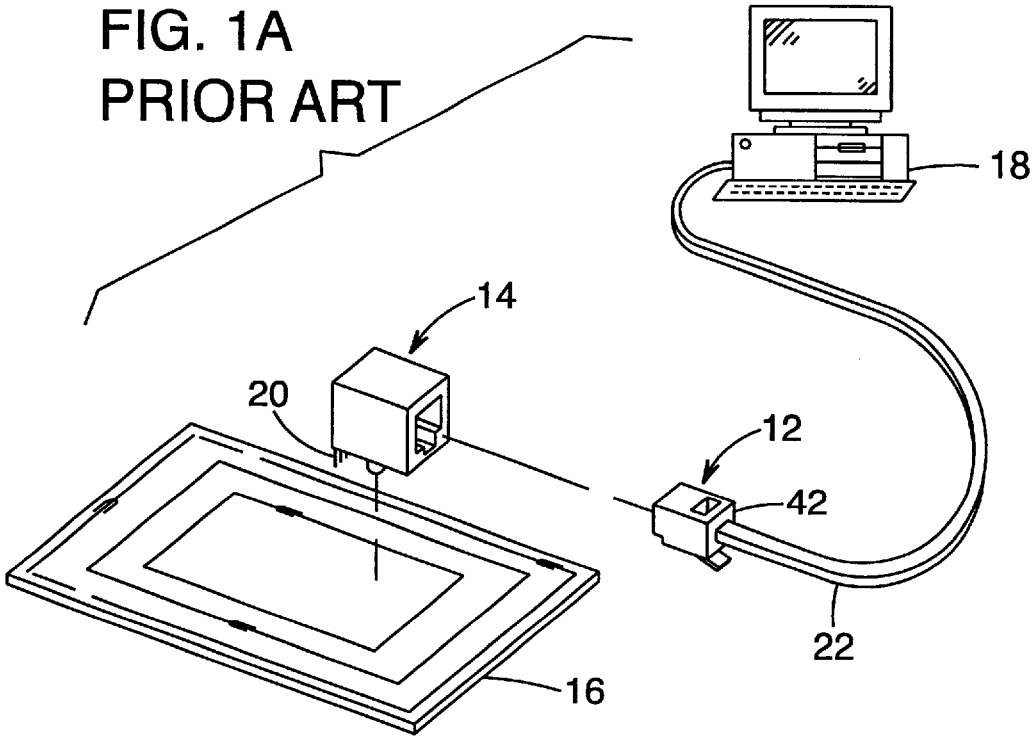
FIG. 1A PRIOR ART
FIG. 1A is a perspective view of plug and jack connectors known in the art.
Figure 1B:
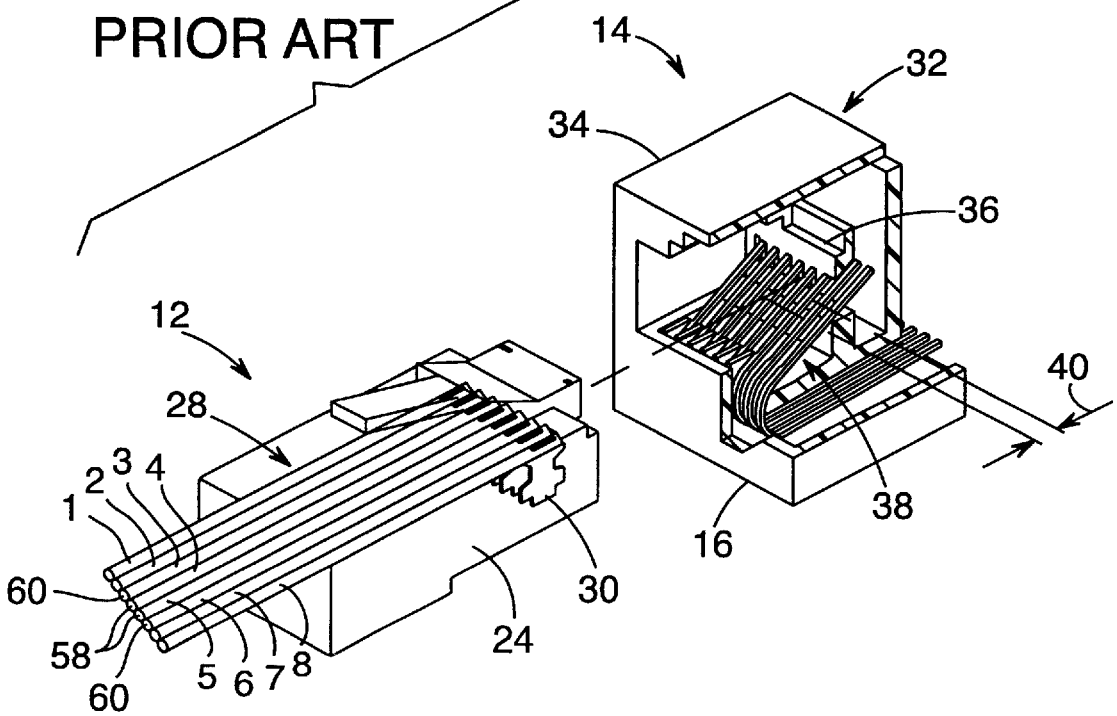
FIG. 1B PRIOR ART
FIG. 1B is a perspective view of a plug connector and a perspective, partially cut away view of a jack connector, both known in the art, and showing additional detail of the conductors disposed with the connectors.

In FIG. 1B, each of the plurality of conductors 28 and 38 of the plug 12 and jack 14, respectively, includes eight conductors. These conductors can be considered as being numbered from 1 to 8, as shown in FIG. 1B. Conductors 4 and 5 can define a one data pair, known in the art as the "inner" pair, and indicated by reference numeral 58, and the conductors either side of the inner pair 58 can define another signal pair, typically known in the art as the "straddle" pair, and indicated by reference numeral 60. In telephony, one conductor of a given pair can be designated the "tip" conductor and the other conductor the "ring" conductor.

Figure 2:
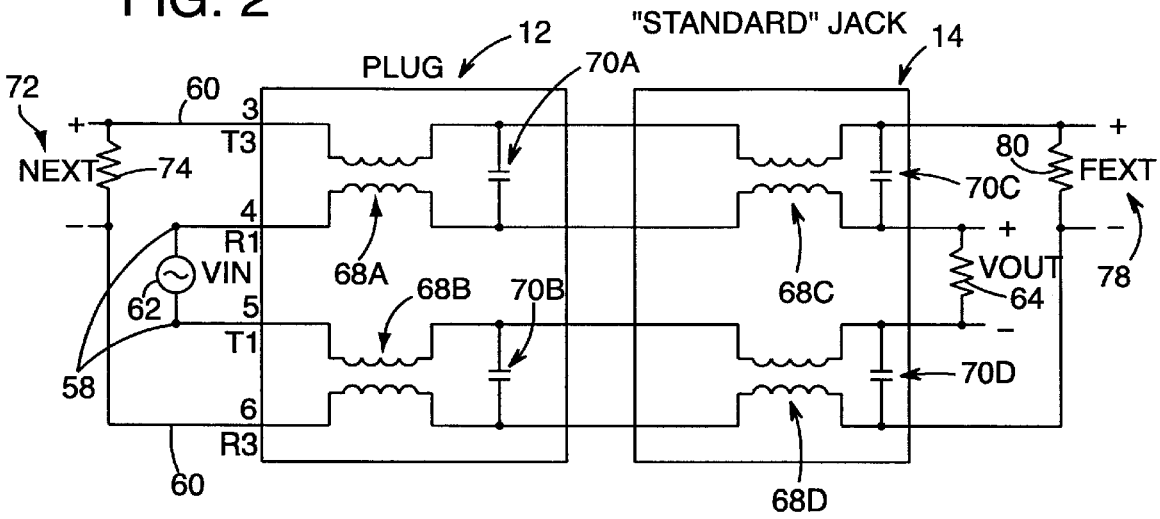
FIG. 2 is an electrical schematic illustrating an electrical model of mated jack and plug connectors, and in particular of the coupling that is understood to contribute to near end cross talk, or NEXT, and far end cross talk, or FEXT.

FIG. 2 is a schematic illustration of an electrical model of a plug connector mated to a jack connector. The electrical model of FIG. 2 illustrates the mechanism by which near end cross talk, or NEXT, and far end cross talk, or FEXT, is thought to be generated.

Consider an information signal generated by the generator 62 and being transmitted by the inner pair 58 of conductors. The signal impressed on the inner pair 58 by the voltage generator 62 appears as a signal across the output load 64 of an external circuit connected to the jack 14. Undesirable inductive coupling between the conductors of the inner pair 58 and the outer pair 60, represented by the transformers 68A and 68B, introduces cross talk onto the straddle pair 60. Similar inductive coupling can take place, as represented by transformers 68C and 68D, in the jack connector. In addition, due to undesirable capacitive coupling between the inner pair 58 and the outer pair 60 in the plug where such capacitive coupling is represented by capacitors 70A and 70B, additional cross talk is introduced to the straddle pair 60 from the inner pair 58. Such capacitive coupling can also occur in the jack connector, as represented by capacitors 70C and 70D. Thus, for the signal 62 impressed upon the inner pair 60, a NEXT signal 72 appears across the load 74 of the external circuit to which the plug is connected, and a FEXT signal 78 appears across the load 80 of the external circuit to which the jack 14 is connected. The NEXT signal 72 and the FEXT signal 80 are the undesired signals which are addressed by the present invention.

The transformers 68A–68D model inductive coupling, which occurs when current in one conductor creates a magnetic field that induces a current in a second conductor. The induced current generates voltages across the resistors 74 and 80 at the near end and the far end of the conductor pair. Note however, that the voltage at the far end, such as the voltage across the resistor 80, is 180 degrees out of phase with the voltage generated the near end 72, such as the voltage across the resistor 74.

The capacitors 70A–70D model cross talk due to capacitive coupling. Capacitive coupling refers to a voltage on one conductor creating an electric field that couples to another conductor, inducing a voltage on the other conductor. This capacitively coupled cross talk is equal at both the near end 72 and the far end 78. That is, the same voltage, in terms of magnitude and phase, appears across resistors 74 and 80.

The total induced voltage (cross talk) at the near end 72 is the sum of the inductive and capacitive induced voltages while at the far end 78 the cross talk is the difference between the two voltages. This can be represented by the equations:

$$NEXT=XT_c+XT_i$$

$$FEXT=XT_c-XT_i$$

where $XT_c$ is the cross talk voltage due to capacitive coupling and $XT_I$ is the cross talk voltage due to inductive coupling.

Typically, when modular connectors are mated, and there is no compensation for cross talk, the capacitive and inductive induced voltages are of the same order of magnitude so the NEXT is quite poor (due to the summation) while the FEXT is quite good (difference between two nearly equal signals). Older communications cabling standards (up to Category 5) specified NEXT because of the significant impact on attenuated signals being received at the near end, and as typical protocols of the time used only one signal path in each direction, FEXT was not important.

Figure 3:
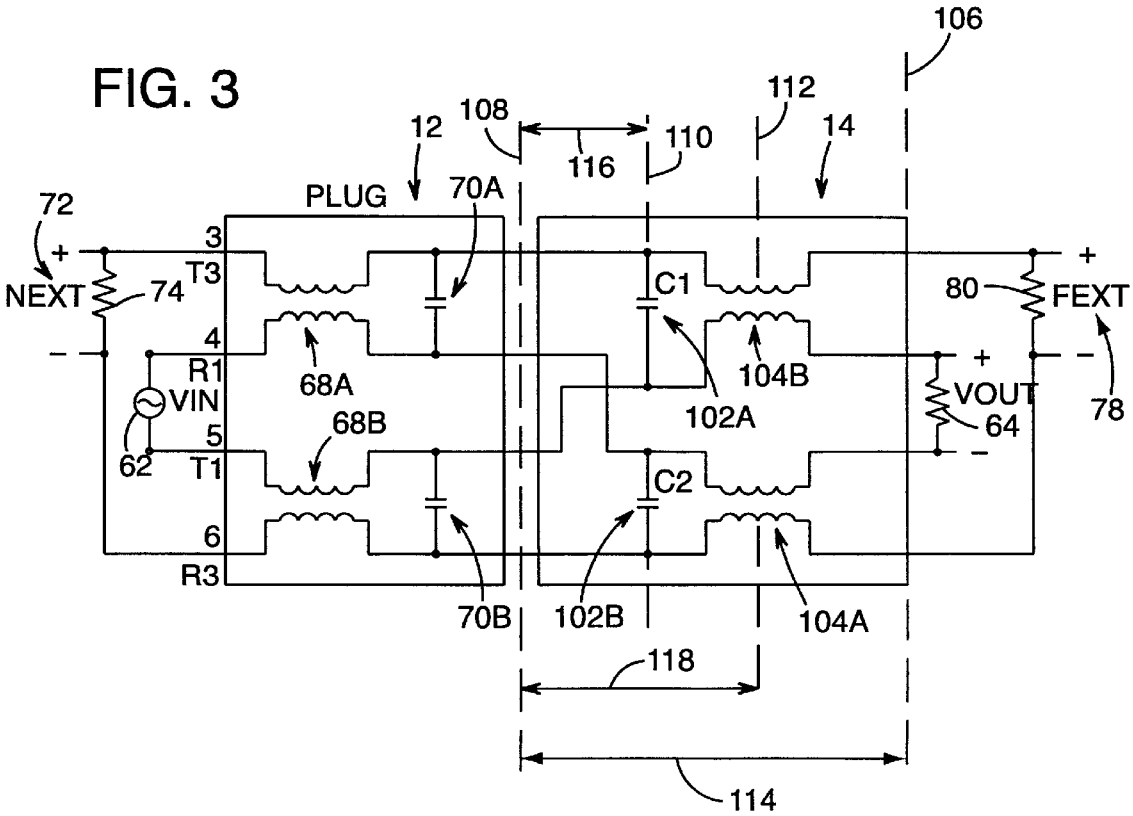
FIG. 3 is an electrical schematic illustrating an electrical model of the a mated plug and jack, where the jack connector includes compensation according to the invention for reducing NEXT and FEXT.

Cross talk can be reduced by creating compensating cross talk to cancel the undesired cross talk. FIG. 3 is an electrical schematic illustrating an electrical model of a mated plug-jack pair, where the jack connector includes compensation according to the invention for reducing cross talk at the near and far ends of the mated pair of connectors. Capacitive elements Cl and C2, indicated by reference numbers 102A and 102B, respectively, introduce a capacitive compensation voltage. Inductive elements 104A and 104B introduce an inductive compensation voltage. Note that the inductive and capacitive elements are connected across the inner conductor pair 58 and the straddle pair 60 so as to induce the compensation signals to cancel the cross talk.

For later reference below, please note that reference numeral 106 in FIG. 3 indicates the phase plane where connection is made to an external circuit such as would physically correspond to the pins 20 of the jack connector 14 of FIG. 1B; reference numeral 108 is the phase plane of the electrical connection between the jack and plug connectors such as would correspond to the contacting portions 40 shown in FIG. 1B; reference numeral 110 indicates the phase plane where the capacitive elements 102A and 102B establish electrical communication with the conductors to which they are connected; and reference numeral 112 indicates the phase plane of the inductive elements 104A and 104B. Thus, the pins 20 are electrically spaced from the phase plane 108 such as by the electrical distance 114; the inductive elements are electrically separated from the phase plane 108 by the electrical distance 118; and the capacitive elements are electrically spaced from the phase plane 108 of the contacts by the electrical distance 116.

For a simple transmission line, electrical distances are usually specified in degrees of phase, and increase linearly with frequency with a slope depending on the physical length of the transmission line that causes the electrical separation.

Known in the prior art are designs that employ either capacitive or inductive compensation coupling within the body of the jack, and designs which employ both capacitive and inductive compensation coupling, with the capacitive compensation on the external circuit, such as the printed circuit board of FIG. 1A.

It is simplest to use inductive compensation to address both capacitive and inductive cross talk, or to use capacitive compensation to address both capacitive and inductive cross talk. This is because compensation is basically introducing a second voltage to cancel an undesired voltage, and because the capacitive cross talk acts as a parallel capacitor and inductive cross talk act as a series transformer. Prior art designs focus on this simple approach. However, prior art designs could actually make FEXT worse, and did not necessarily optimally reduce NEXT, as is shown below.

According to the invention, however, it is possible to improve the reduction of NEXT and to also simultaneously reduce FEXT.

In this approach, capacitive and inductive compensation are both preferably employed, with the capacitive compensation and amount of inductive compensation each properly selected. Various cases are discussed below.

Case 1: Capacitive only compensation:

It is possible to address NEXT with capacitive compensation only, as discussed above. The capacitive compensation can be selected to be equal to and out of phase with NEXT:

$$COMP_c=-NEXT=-XT_c-XT_i$$

$$NEXT_{NEW}=NEXT+COMP_c$$

$$NEXT_{NEW}=XT_c+XT_i-XT_c-XT_i=0$$

where $COMP_c$ is the capacitively coupled compensation voltage.

Unfortunately, the FEXT suffers:

$$FEXT_{NEW}=FEXT+COMP_c$$

$$FEXT_{NEW}=XT_c-XT_i-XT_c-XT_i=-2\ XT_i$$

The NEXT is theoretically zero, but the FEXT is sacrificed!Nevertheless approach is understood to be used in at least one Category 5 prior art jack design.

Case 2: Inductive compensation:

Inductive compensation can also be used to alone address NEXT, as is also discussed above. Ideally, inductive compensation is set equal to and out of phase with NEXT:

$$COMP_i=-NEXT=-XT_c-XT_i$$

$$NEXT_{NEW}=NEXT+COMP_i$$

$$NEXT_{NEW}=XT_c+XT_i-XT_c-XT_i=0$$

where $COMP_c$ is the capacitively coupled compensation voltage.

But, since inductive signals are out of phase at opposite ends:

$$FEXT_{NEW}=FEXT-COMP_i$$

$$FEXT_{NEW}=XT_c-XT_i+XT_c+XT_i=2XT_c$$

Again NEXT is good but FEXT is sacrificed. Nevertheless the foregoing approach is understood to be used in at least one known Category 5 jack, which device is of course different than the device referred to in case I.

Case 3: Inductive AND capacitive compensation:

According to the invention, it is possible to reduce NEXT, while simultaneously reducing FEXT. Furthermore, NEXT performance can be improved over the prior art. Consider applying both capacitive and inductive compensation, with the inductive compensation and capacitive compensation selected as below:

$$COMP_c = -XT_c$$

$$COMP_i = -XT_i$$

$$NEXT_{NEW} = NEXT + COMP_{c+COMPi}$$

$$NEXT_{NEW} = XT_c + XT_i - XT_c - XT_i = 0$$

and:

$$FEXT_{NEW} = FEXT + COMP_c - COMP_i$$

$$FEXT_{NEW} = XT_c - XT_i - XT_c + XT_i = 0$$

Thus, when capacitive and inductive compensation are both used, and, furthermore, the capacitive compensation is selected to address substantially only the capacitive cross talk (that is to provide a voltage to cancel the cross talk due to capacitive coupling) and the inductive compensation selected to address substantially only the inductive cross talk (that is, to provide a voltage that cancels the cross talk voltage due to inductive coupling) both NEXT and FEXT are ideally zero. Note than one of NEXT and FEXT can be ideally zero even when, for example, the capacitive compensation is selected to compensate ⅓ of the capacitive and inductive cross talk voltages and the inductive compensation is selected to cancel the other ⅔ of the capacitive and inductive cross talk. However, the other of the NEXT and FEXT is understood to suffer and be other than zero, even ideally.

Figure 4A:
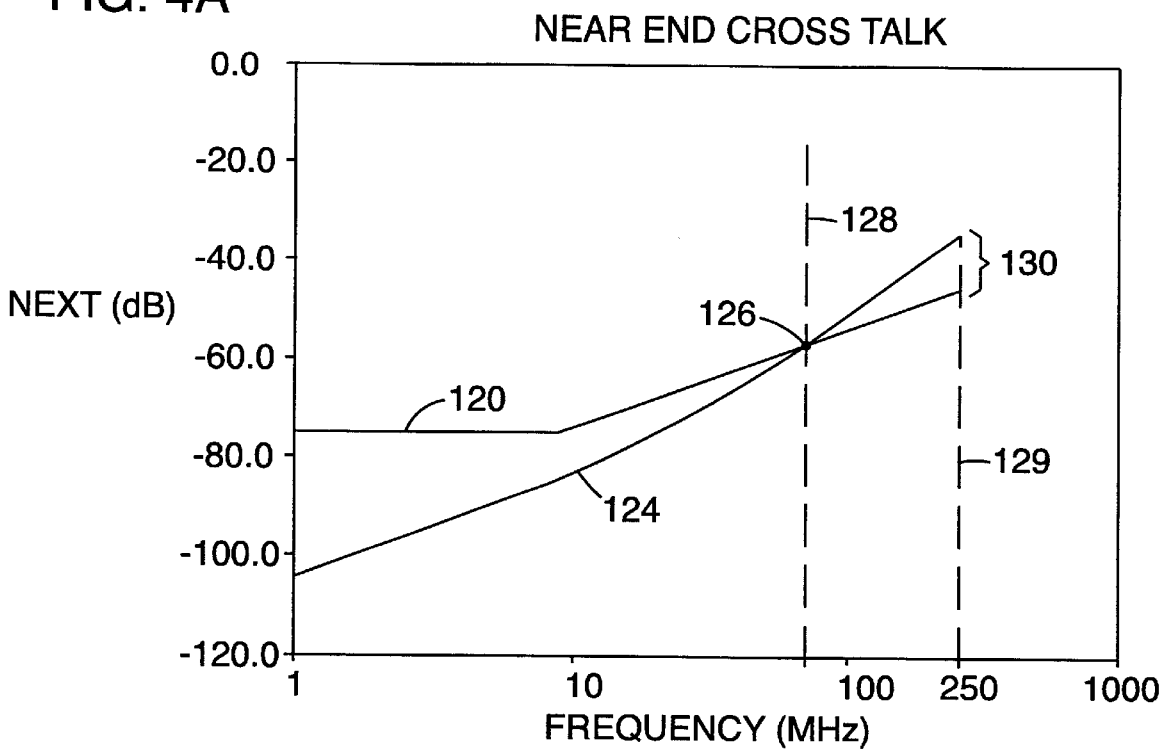
FIG. 4A is a plot of NEXT versus frequency, showing the Category 6 limit and the performance of a mated jack and plug connector where a capacitive element is used to compensate for the both the inductive and capacitive components of the cross talk.

Modeling using the SPICE™ program using models for actual jack and plug connectors confirms the above analysis. For example, FIG. 4A is a plot of NEXT versus frequency for a capacitive compensation design, that is, for a design where a capacitive element is selected to compensate for cross talk voltages, without reference to whether the cross talk is inductive or capacitive. The vertical axis of FIG. 4A is in decibels and the horizontal axis is a log plot in MHz. The curve 120 represents the Category 6 standard for NEXT, which can extend to a frequency of 250 MHz. The curve 124 represents the cross talk when the aforementioned capacitive compensation is applied, where the capacitive compensation includes a capacitor on the external circuit to which jack connected is connected, as is known in the art. The curves 120 and 124 intersect at the point 126, and as indicated by the vertical line 128, the Category 6 specification is exceeded at a frequency less than 100 MHz. As indicated by reference numeral 130, the Category 6 standard can be exceeded by approximately 10 dB at a frequency of 250 MHz.

Figure 4B:
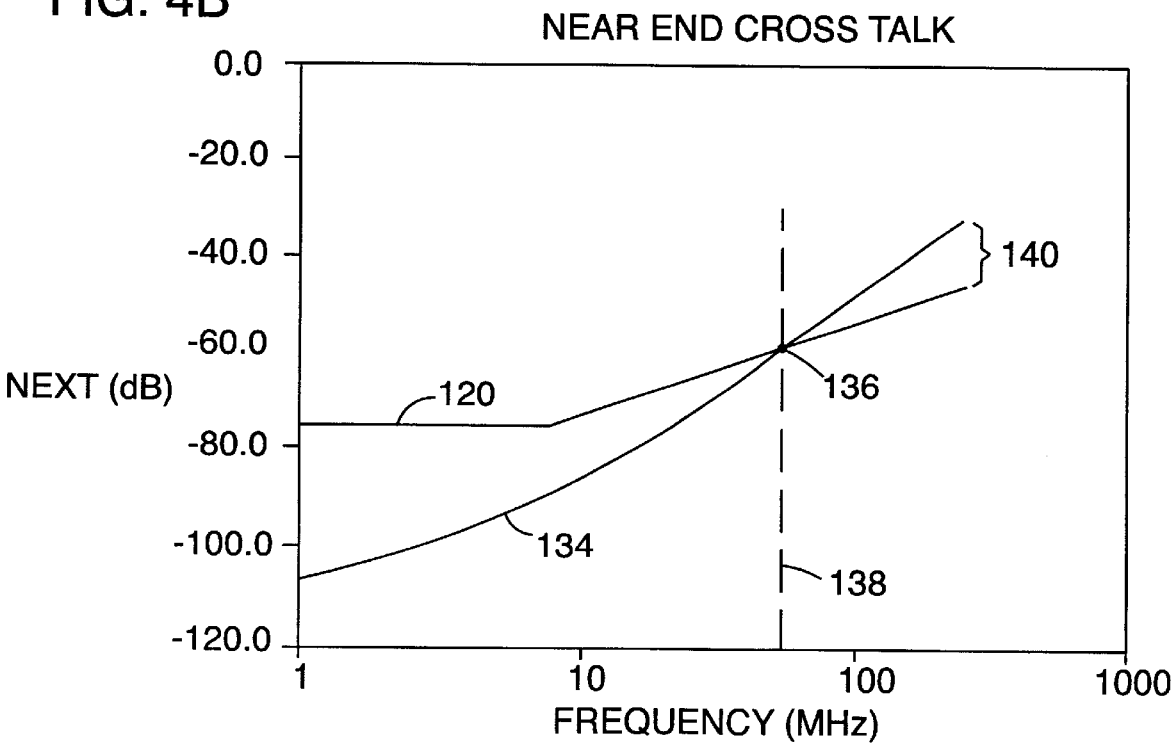
FIG. 4B is a plot of NEXT versus frequency, showing the Category 6 limit and the performance of a mated jack and plug connector where an inductive element is used to compensate for the both the inductive and capacitive components of the cross talk.

FIG. 4B is a plot of NEXT versus frequency for an inductive compensation design, that is, for a design where inductive compensation is selected to compensate for cross talk voltages, again without reference to whether the cross talk is inductive or capacitive. The vertical axis of FIG. 4A is in decibels and the horizontal axis is a log plot in MHz. The curve 120 again represents the Category 6 standard for NEXT, which can extend to a frequency of 250 MHz. The curve 134 represents the cross talk when the aforementioned inductive compensation is applied in the jack connector. The curves 120 and 134 intersect at the point 136, and as indicated by the vertical line 138, the Category 6 specification is again exceeded at a frequency less than 100 MHz. As indicated by reference numeral 140, the Category 6 standard can be exceeded by approximately 10 dB at a frequency of 250 MHz.

Figure 5A:
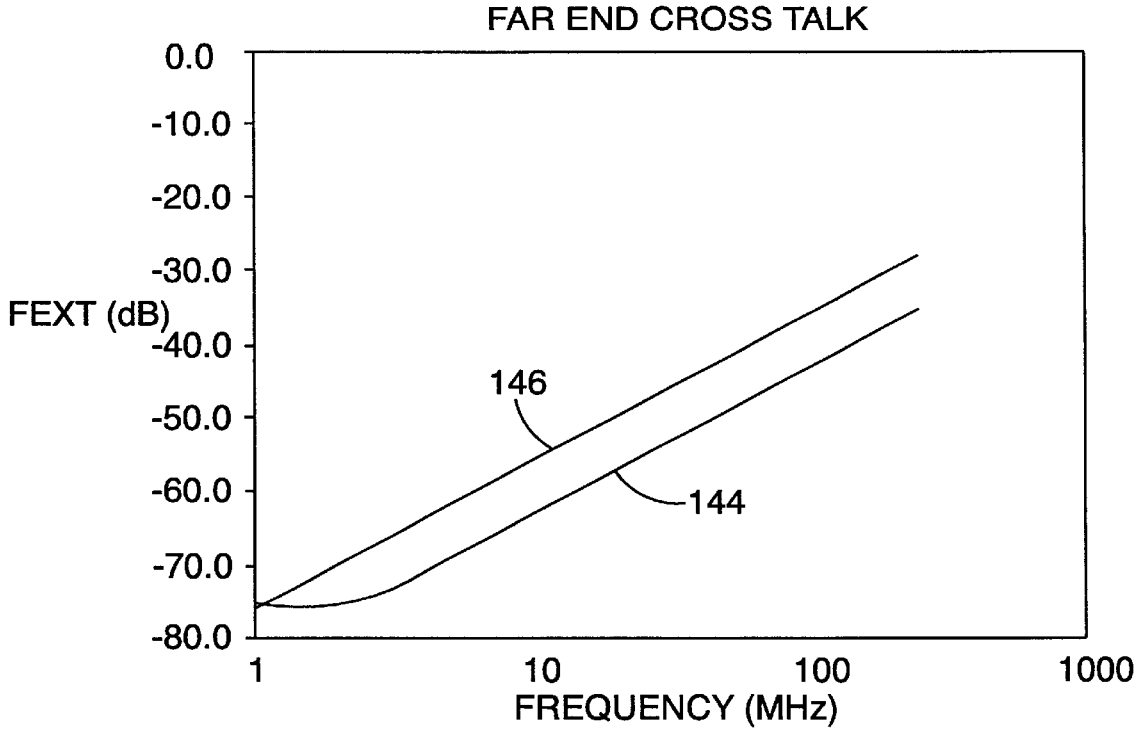
FIG. 5A is a plot of FEXT versus frequency, showing the Category 6 limit and the FEXT produced by the mated connector pair having the NEXT shown in FIG. 4A.
Figure 5B:
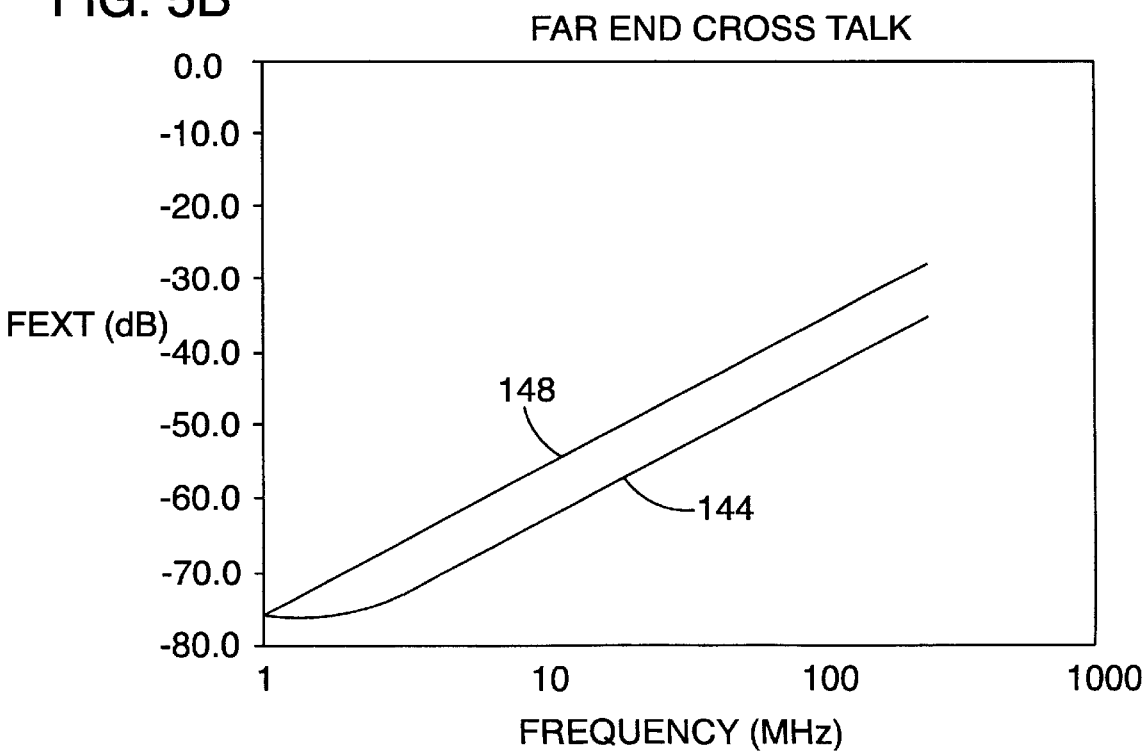
FIG. 5B is a plot of FEXT versus frequency, showing the Category 6 limit and the FEXT produced by the mated connector pair having the NEXT shown in FIG. 4B.

FIGS. 5A and 5B are plots of the FEXT for the designs of FIGS. 4A and 4B respectively. Curve 144 is the Category 6 FEXT specification for FEXT; curve 146 is the FEXT of the capacitive compensation design whose NEXT is plotted as curve 124 in FIG. 4A, and curve 148 FIG. 5B is the FEXT produced by the inductive compensation design having the NEXT plotted as curve 134 in FIG. 4B. The FEXT for both designs exceeds the Category 6 specification throughout the frequency range plotted.

Figure 6A:
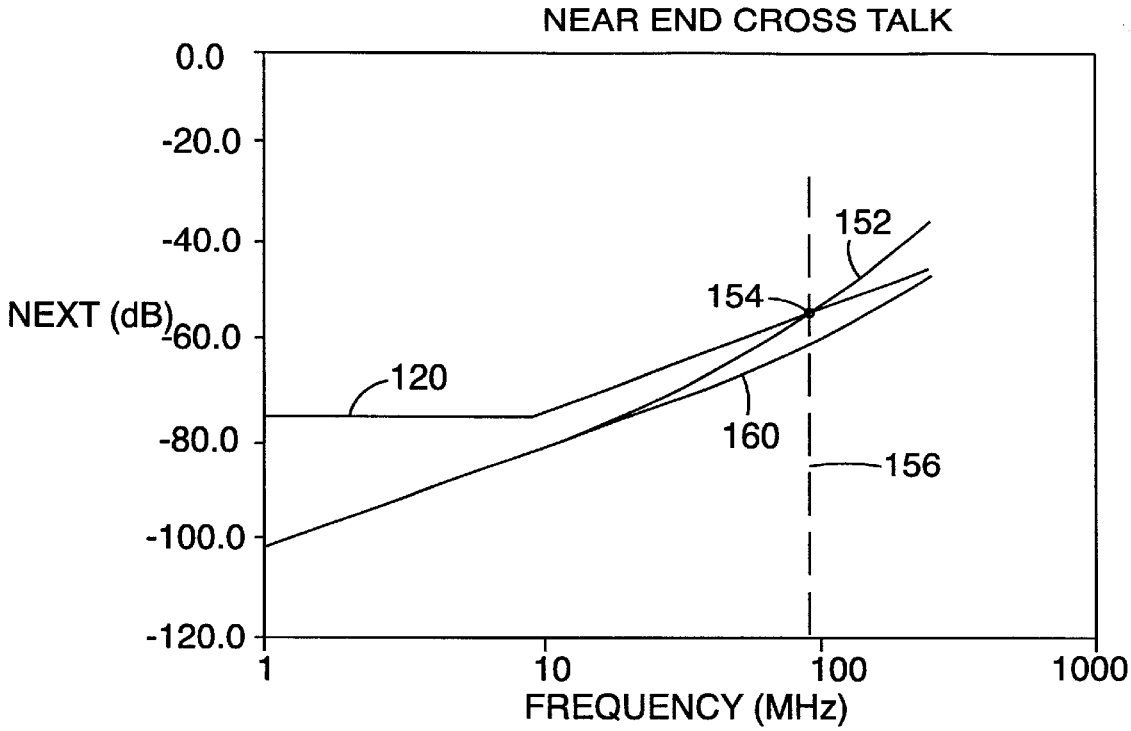
FIG. 6A is a plot of NEXT versus frequency, showing the category 6 limit as well as the performance of a mated jack and plug connectors where the jack includes compensation according to the invention.

FIG. 6A is a plot of NEXT versus frequency, where curve 120 represents the Category 6 specification for NEXT. Curve 152 represents NEXT where the inductive compensation is provided to address the inductive cross talk and capacitive compensation is provided to address the capacitive cross talk. The inductive compensation is disposed with the jack connector, and capacitive compensation applied at the external circuit to which the jack 14 is electrically connected, which can correspond to electrically applying the capacitive compensation at the phase plane 106 in FIG. 3.

Note that the NEXT is considerably improved over the NEXT of FIGS. 4A and 4B, in that the curve 152 crosses the category 6 curve 120 at nearly 100 MHz. (When comparing FIGS. 4A and 4B with FIG. 6A, remember that the MHz scale is logarithmic). Significantly, FEXT is reduced. FIG. 6A is a plot of FEXT versus frequency, where curve 170 is the Category 6 specification, and curve 172 is the FEXT corresponding to curve 152 in FIG. 6A. The FEXT is below the Category 6 specification for all frequencies plotted, typically meeting the Category 6 specification by approximately 20 dB. Extrapolating by eye, FEXT likely remains below the Category 6 specification for frequencies well in excess of 250 MHz.

However, curve 152 does not meet the Category 6 specification. It is not entirely below curve 120. Curve 152 crosses curve 120 at the point 154, shown in FIG. 6A.

Further analysis and design was performed. Such analysis is typically an iterative process that involves modification, analysis, such as with the SPICE analysis program, and further modification based on the results of the prior analysis. One hopes this iterative process converges on an acceptable overall design after a finite number of iterations. Modifications to designs are usually made based on the experience, intuition of the designer.

Figure 6B:
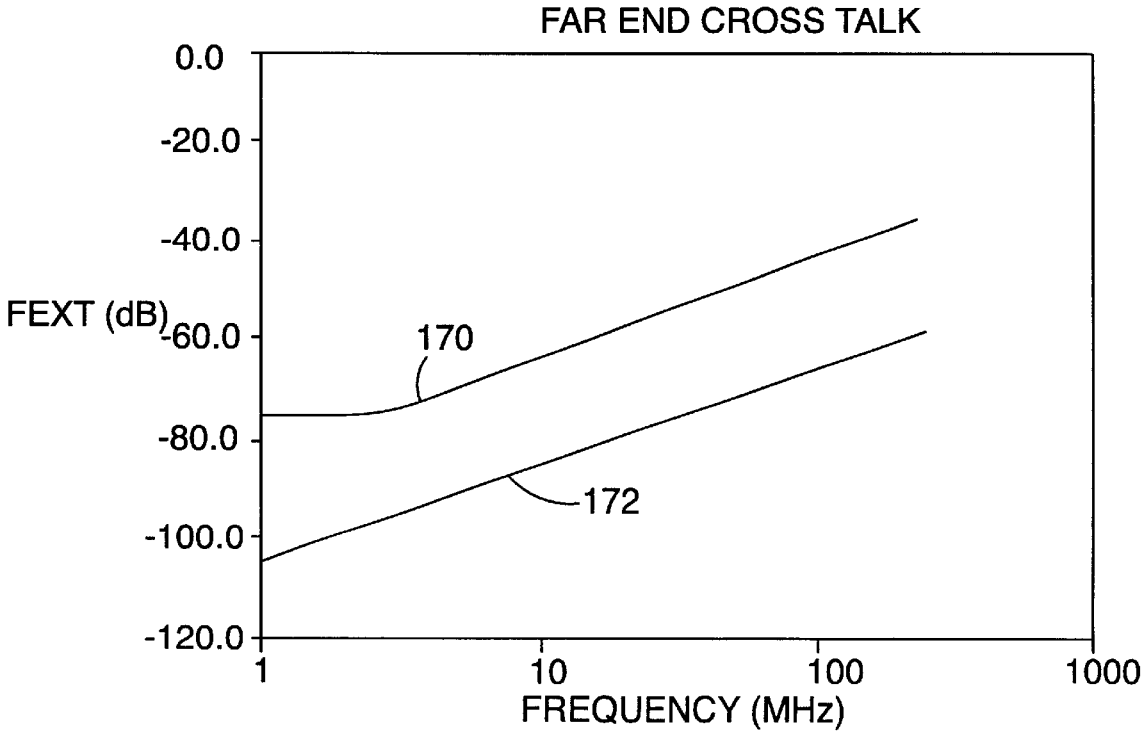
FIG. 6B is a plot of FEXT versus frequency, showing the Category 6 specification and the FEXT of a mated jack and plug compensated according to the invention and having the NEXT of FIG. 6A.

Curve 160 represents the results of such additional design work, and is a plot of the NEXT versus frequency where the Category 6 specification is met up to and including 250 MHz. Returning to FIG. 6B, which is a plot of FEXT versus frequency, curve 170 is the FEXT produced also represents the FEXT corresponding to 160 in FIG. 6A. Thus, according to the invention, cross talk can be reduced in connectors, including reducing both FEXT and NEXT.

Curve 160 represents moving the capacitive element such that it is electrically nearer to the contact portions of the appropriate connectors. One approach is to dispose the capacitive element with the jack connector. Preferably, the inductive element is not interposed electrically in between the capacitive element and the contacting portions and the capacitive element.

It is considered that the increase in performance represented by curve 152 and 160 can be understood as due to an undesirable phase shift occurring in the conductors of the connector, which phase shift detrimentally interferes with the application of the capacitive compensation. Moving the capacitive element nearer to the contacting portions reduces the effect of such phase shift.

Conductors that are sufficiently proximate to one another can act as a transmission line, which transmission line can be modeled by a series inductance per unit length along the transmission line and a parallel capacitance per unit length along the transmission line, and are further characterized by a characteristic impedance and a phase constant, which can often be calculated form the capacitance and inductance per unit length. One can determine the electrical phase shift introduced by a physical length of transmission line, given the frequency and the phase constant of the transmission line. The phase shift increases with frequency. Transmission line theory usually considers infinitely long, uniform structures, such as two parallel wires spaced by a fixed distance and surrounded by a single, uniform substance (e.g., air) having a single dielectric constant. For these structures, the capacitance per unit length, inductance per unit length, impedance and phase constant. Adding bends and turns to the conductors, as well some different dielectric materials around the wires, such as air and plastic, and the analysis quickly becomes complicated.

More complicated structures, such as the geometrically complex conductors of a typical modular connector, which can typically have bends, and include various dielectrics at varying distances from the conductors, are not necessarily amenable to any straightforward analysis. The frequency at which such a structure may exhibit transmission line behavior, and the nature of the behavior, is not readily apparent, especially to those of ordinary skill in the art of modular connectors. According to the invention, it is now known that the conductors of a modular connector can introduce a phase shift that must be accounted for when introducing capacitive compensation for cross talk.

Accordingly, in one embodiment of the invention, substantially only capacitive cross talk is addressed by a capacitive compensation, and substantially only inductive cross talk is addressed by inductive compensation. In another embodiment, providing capacitive compensation includes providing a capacitive element that is electrically applied as near as possible to the contact portions of the appropriate conductors, i.e., as near as possible to the phase plane 108 in FIG. 3. Typically, applying the capacitive compensation electrically near the contacting portions means that the capacitive element is physically located as near as possible to the contacting portion of the appropriate conductors as well.

Furthermore, inductive compensation, if present, is not electrically interposed between the capacitive element and the contacting portions of the conductors. Introducing selective inductive compensation can involve increasing the inductive coupling, for a selected length, between selected conductors, and/or decreasing the inductive coupling between other conductors as is described in more detail below. It is considered that inductive compensation, such as is provided by the inductive element described above, when introduced electrically between the capacitive element and the contacting portions, can also contribute phase shift that lessens the effectiveness of capacitive compensation. Accordingly, in one aspect of the invention, the capacitive compensation is applied such that the inductive compensation is not electrically located between capacitive compensation and the contacting portions of the appropriate conductors. Thus, it is preferable to avoid electrically interposing the inductive elements 104A and 104B between the capacitive elements 102B and 102A, such as would occur if the capacitive elements 102A and 102B were to be electrically located at the phase plane 106 in FIG. 3.

Preferably, to ensure that cross talk is reduced over a selected frequency range having an upper limit frequency, the phase shift between the contacting portions of the appropriate conductor and the capacitive element is less than about five (5) degrees over the frequency range, and more particularly, is less than about five (5) degrees at the upper frequency limit; more preferably, the phase shift is less than about four (4) degrees over the frequency range, and more particularly, is less than about four (4) degrees at the upper frequency limit; most preferably, the phase shift is less than about three (3) degrees over the frequency range, and more particularly, is less than about three (3) degrees at the upper frequency limit.

Preferably, the capacitive element provides a capacitance in the range of about 0.3 pf to about 0.7 pf; more preferably, the capacitance is in the range of about 0.4 pf to about 0.6 pf, and most preferably, the capacitance is about 0.5 pf.

The term "capacitive element", as used herein, refers to an electronic component that provides a capacitive impedance. Similarly, the term "inductive element", as used herein, refers to an element that provides an inductive impedance. For example, a capacitive element can provide an impedance having a negative imaginary part, whereas an inductor can provide an impedance having a positive imaginary part. The sign of the imaginary part of the impedance is indicative of the phase of the relationship between the voltage across an element to the current in the element. One example of capacitive element is a discrete capacitor. Other examples include a pair of wires, such as a twisted pair of wires; planar capacitors disposed on a printed circuit board or other substrate and that use the substrate material as the dielectric between the planar conductive regions; and interdigitated capacitors disposed with a substrate, such as by depositing metal on a printed circuit board. Capacitive elements can also be formed by depositing metal on the body, such as on the lead frame, of the modular connector, or by arranging sections of the conductor such that the electric fields of one conductor can couple to another conductor to store appropriate charge thereon, hence inducing a voltage on the other conductor. A suitable length of a transmission line can also provide a capacitive impedance, and hence is another example of a capacitive element. According to the invention it is disclosed that the electrical spacing between a capacitive element and the contract portions is preferably as small as possible. The capacitive element need not necessarily be of a particular type to realize the benefits of the invention.

Also, as understood by one of ordinary skill, in light of the disclosure herein, "electrical communication" can be established between an electrical element and a conductor without actual physical connection; for example, the capacitive elements can be capacitively coupled to the conductors with which they electrically communicate.

Figure 7A:
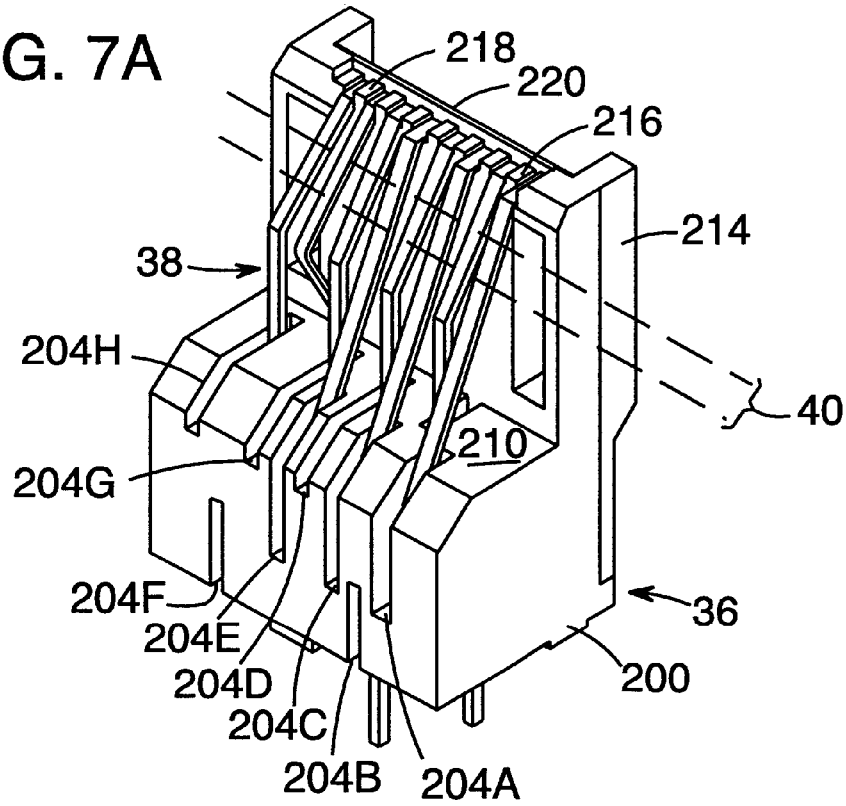
FIG. 7A is a front perspective view of a jack connector according to the invention, showing the plurality of conductors and the printed circuit board that includes capacitive elements.
Figure 7B:
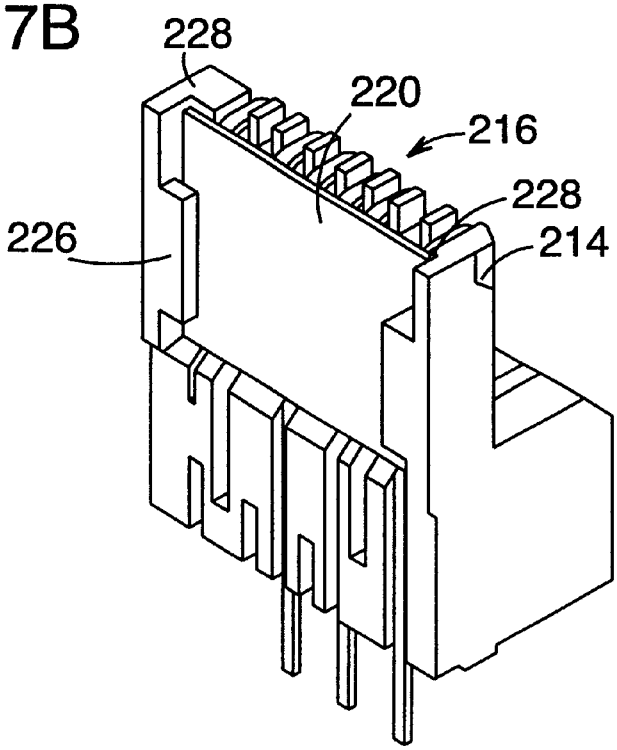
FIG. 7B is a rear perspective view of the jack connector of FIG. 7A.

FIGS. 7A and 7B are front and rear perspective views, respectively, of one embodiment of a jack connector in accordance with the invention. The lead frame 36 can include a rectangular base 200 defining a plurality of slots 204A–204H for guiding and/or supporting the plurality of conductors 38. The base 200 includes an upper platform 210, and a back 214 that extends vertically from the rear of the upper platform 210 and which includes a ridge 216 including dividers 218. The slots 204A–204H can open to the platform 210, and conductors of the plurality of conductors 38 emerge from slots and extend, a various angles to the plane of the platform 210, to the ridge 216. The ridge 216 supports the upper ends of the plurality of conductors 38, with the dividers 218 separating individual conductors of the plurality of conductors 38.

The lead frame 36 mounts a substrate 220, e.g., printed circuit board, which in turn includes compensating capacitive elements (not shown) for electrical communication with selected conductors of the plurality of conductors 38. The back 214 of the lead frame 36 can include tabs 226 and shoulders 228 for confining the printed circuit board 220 therebetween. The lead frame 36, plurality of conductors 38, and printed circuit board 220 thus provide a compact arrangement wherein capacitive elements can be located electrically nearer to the contact portion, indicated generally by reference numeral 40, of the plurality of conductors 38.

Those conductors of the plurality of conductors that are to electrically communicate with one of the capacitive elements of the printed circuit board can include generally u-shaped upper portions (not readily visible in FIGS. 7A and 7B), which wrap, at least partially, for electrical communication with the capacitive elements of the printed circuit board 220.

Figure 8A:
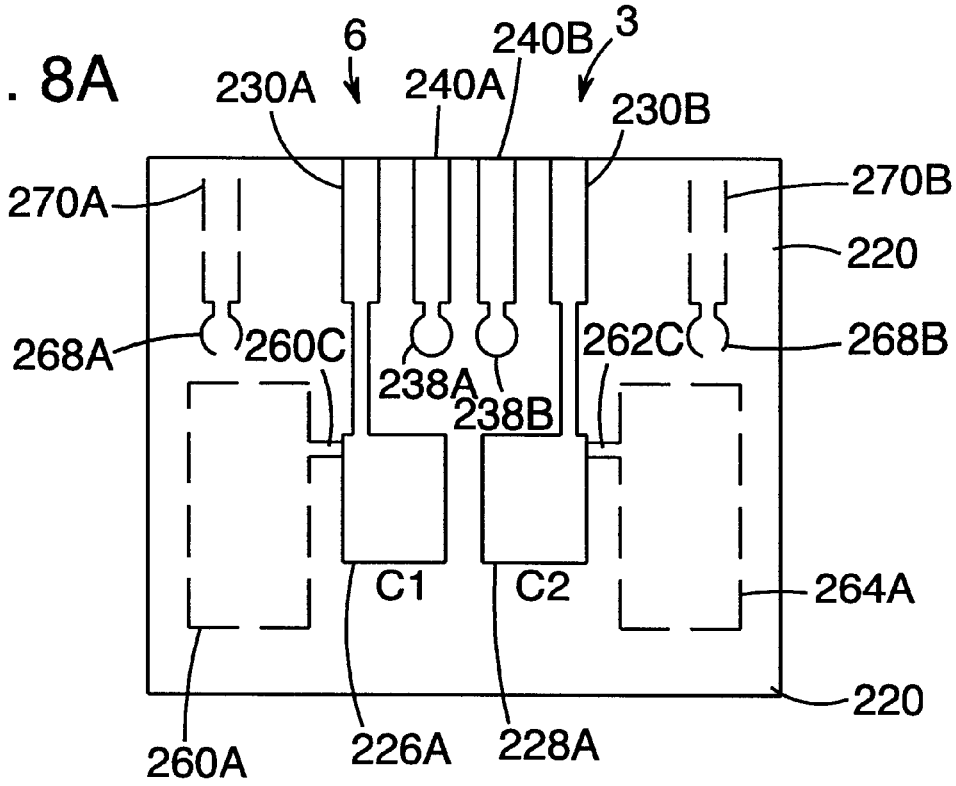
FIG. 8A is a top view of the printed circuit board of the jack connector of FIGS. 7A and 7B.

FIGS. 8A are top and bottom views, respectively, of the printed circuit board 220 of the jack connector shown in FIGS. 7A and 7B, illustrating the capacitors C1 and C2 of FIG. 3.

Figure 8B:
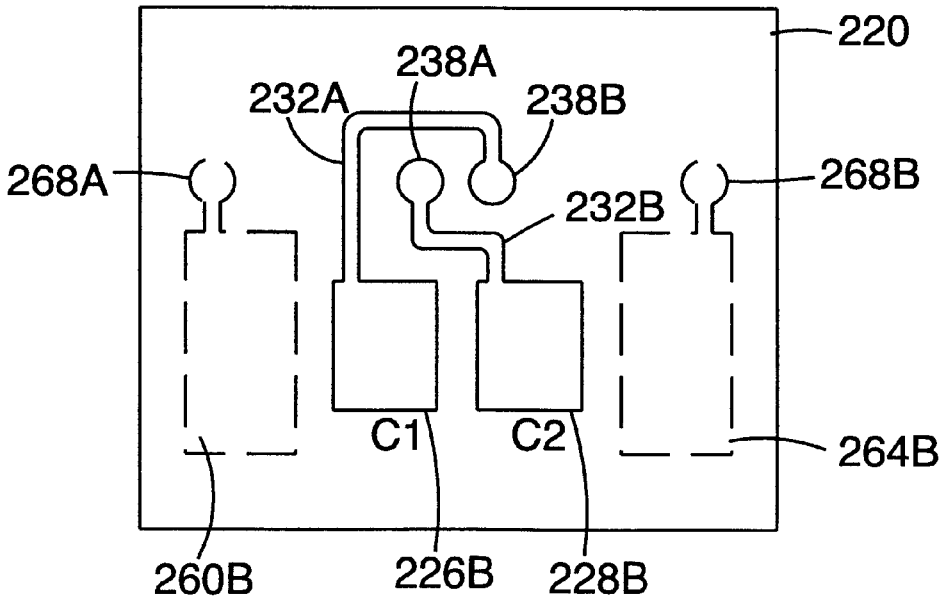
FIG. 8B is a bottom view of the printed circuit of the jack connector of FIGS. 7A and 7B.

Capacitor C1, which corresponds to the capacitive element 102A in FIG. 3, includes upper planar conductive area 226A and lower planar conducive area 226B. The capacitor C2, which corresponds to the capacitive element 102B in FIG. 3, includes upper planar conductive region 228A and lower planar conductive region 228B. Conductive paths 230A and 230B extend from the conductive planar areas 226A and 226B, respectively, toward the upper edge of the printed circuit board 220, for electrical connection to an appropriate u-shaped portion of one of the conductors of the plurality of conductors 38. With reference to FIG. 8B, conductive paths 232A and 232B connect the conductive planar areas 226B and 228B, respectively, to the conductive via holes 238A and 238B, respectively. As shown in FIG. 8A, the conductive paths 240A and 240B connect with the via holes 238A and 238B, respectively, and lead to the edge of the printed circuit board 220 so as to make electrical connection with appropriate u-shaped portions of conductors of the plurality of conductors when the printed circuit board is received by the lead frame 36.

The conductive areas and/or paths can be formed by conductive metals deposited on the printed circuit board 220. One method of defining the conductive areas and/or paths is to deposit a suitable metal, such as by sputtering, evaporation, etc., over a surface of the printed circuit board 220 and to then use photolithographic techniques to etch away undesired metal, thereby leaving the desired conductive areas and/or paths. Alternatively or additionally, metal can be selectively deposited on the printed circuit board 220 to form conductive areas and/or paths.

Note that the printed circuit board 220 can optionally include other capacitors for providing compensation. Planar conductive area 260A forms a one optional capacitor with planar conductor area 260B. Planar conductor 260B is electrically connected to via hole 268A, which in turn is electrically connected to conductive path 270A in FIG. 8A. Conductive path 270A extends to the edge of the printed circuit board 220 for connection with an appropriate u-shaped portion of one of the plurality of conductors 28. Similarly, conductive area 264A forms another optional capacitor with conductive area 264B, which capacitor is in electrical communication with via hole 268B, which in turn is connected to conductive path 270B. Conductive path 270B runs to the upper edge of the printed circuit board 220 for appropriate connection with a unshaped portion of one of the plurality of conductors 28. Note also that the conductive planar regions 260A and 264A are electrically connected respectively with the conductive regions 226A and 228A as indicated by reference numerals 260C and 262C. These optional capacitors are further discussed below.

Figure 9:
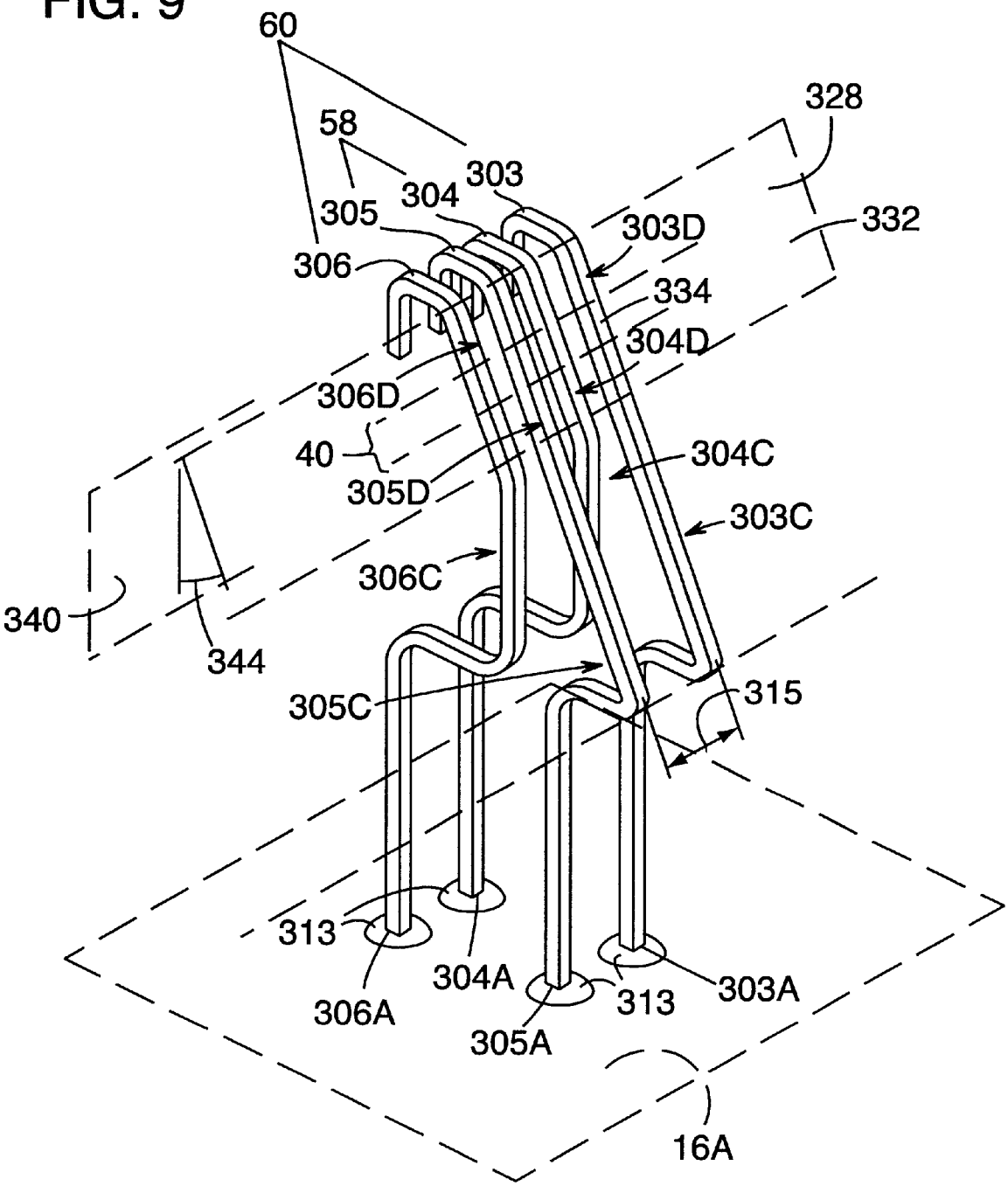
FIG. 9 is a perspective view of the inner and straddle pairs of conductors of the jack connector of FIGS. 7A and 7B.

FIG. 9 shows the inner conductor pair 58 and straddle conductor pair 60 shown in FIGS. 7A and 7B. The inner pair 58 includes conductors 304 and 305, and the straddle pair 60 includes conductors 303 and 306. Each of the four conductors shown in FIG. 9 includes a contact portion, which contact portions include the sections of each conductor in between the two lines indicated by reference numeral 40. The contact portions are arranged in a row for electrical connection with the electrical contacts of a plug connector when mated with the jack connector of the present invention. Note that in FIG. 9 the conductor 303 is next to the conductor 304, the conductor 304 is next to the conductor 305, and the conductor 305 is next to the conductor 306. Thus the four conductors 303–306 are also arranged in a row. Each of the conductors includes a pin portion (e.g., 303A, 304A, 305A and 306A) for connection with an external circuit, such as the circuit board 16A shown in FIG. 9, for communication of signals between the contacts of the plug connector and the external circuit board 16A. Solder joints 313 can connect the conductors to the external circuit board 16A.

Note that the conductor 303 includes a section 303C that is parallel to the section 305C of the conductor 305, and the conductor 304 includes a section 304C that is parallel to the section 306C of the conductor 306, and that the sections 303C and 305C are not parallel to the sections 304C and 306C. Thus, the sections 303C and 305C are selectively inductively coupled, and the sections 304C and 306C are selectively inductive coupled. The sections 304C and 306C form a inductive element, such as the inductive element 104A in FIG. 3, that is arranged to provide a selected inductive coupling between the conductors 304 and 306. Similarly, the section 303C and 305C form a second inductive element, such as the inductive element 104B in FIG. 3, that is arranged to provide second selected inductive coupling between conductors 303 and 305. However, inductive coupling between the sections 303C and 304C, between the sections 304C and 305C, and between the sections 305C and 306C is reduced, as these pairs of sections are not parallel. The inductive coupling of a particular pair of section can be responsive to the length of the sections, the spacing therebetween, and the degree to which the section are co-oriented. It two sections are parallel, coupling is enhanced; if they are perpendicular, coupling is reduced. As shown in FIG. 9, sections 303C, 304C, 305C and 306C are arranged in a row. This row of conductor pairs are so shaped as to provide nonparallel or skewed conductor sections within each conductor pair.

Note also that conductor 303 includes another section 303D; the conductor 304 includes another section 304D, the conductor 305 includes another section 305D, and the conductor 306 includes another section 306D. Furthermore, the "D" section of each conductor forms a continuous length with the "C" section of that conductor. Note also that the sections 303C and 303D form a continuous straight length of the conductor 303, and the sections 305C and 305D form a continues straight length of the conductor 305. Preferably, the sections 303D–306D are coplanar and the sections 303C and 305C lie in the plane 328 of the sections 303D–306D. Furthermore, the sections 303C and 305C are preferably parallel and coplanar with the sections 303D–306D. Typically, the contact portions 40 are all substantially parallel and lie in the plane 328.

Note that the "A" sections of the conductors shown in FIG. 9, that is, sections 303A–306A, are preferably also arranged, in conjunction with the "C" sections, to provide inductive coupling between the conductors 303–306 to help compensate for inductive cross talk. The shape of the conductors 303–306 can be analyzed and optimized using the SPICE™ circuit analysis program.

Typically, the center-to-center spacing indicated by reference numeral 315 is approximately 0.080", and the center to center spacing of adjacent conductors is approximately 0.040".

Note the plane 328 includes a front 332, which is toward, or faces, the plug connector when mated with the jack connector that includes the lead frame 36 of FIGS. 7A and 7B, such that the plug connector will lie substantially on the front side of the plane 328. The contact portions 40 also include front faces, of which the front face 334 is representative.

Reference numeral 340 indicates a plane parallel to the plane of the circuit board 220 when disposed with the lead frame 36. Note that the circuit board 220 lies behind the plane 328, and that the plane 340 of the circuit board defines an acute angle 344 with the plane of the circuit board 220. Thus the circuit board tucks behind the back 214 of the lead frame 36 for providing a compact jack connector that provides for electrical communication between compensation capacitors and the conductors, where electrical communication can be established electrically nearer to the contact portions than when the capacitors are connected at the "A" sections of the conductors.

FIG. 10 shows a preferred embodiment of the conductors of the jack when more than four conductors are present in the jack. Note that the geometric arrangement shown in FIG. 9 is not simply repeated. In arriving at the design of FIG. 10, the configuration of appropriate sections of the inner pair 58 of conductors and of appropriate sections of the straddle pair 60 was selected to provide a desired inductive coupling for canceling NEXT and FEXT. However, analysis then revealed undesirable cross talk between the straddle pair and the first outer pair of conductors (301 and 302) and between the straddle pair and the second pair of outer conductors (307 and 308). Design changes were made to appropriate sections of the outer pair, and analysis performed, in an iterative process, until this cross talk was sufficiently reduced. However, further analysis then revealed undesirable cross talk between the one or both of the outer pairs of connectors and the inner pair 58. Accordingly, the outer pairs were modified, and analysis performed, and eventually the structure shown in FIG. 10 was found to be satisfactory, in that cross talk between the pairs of conductors was reduced.

Figure 10A:
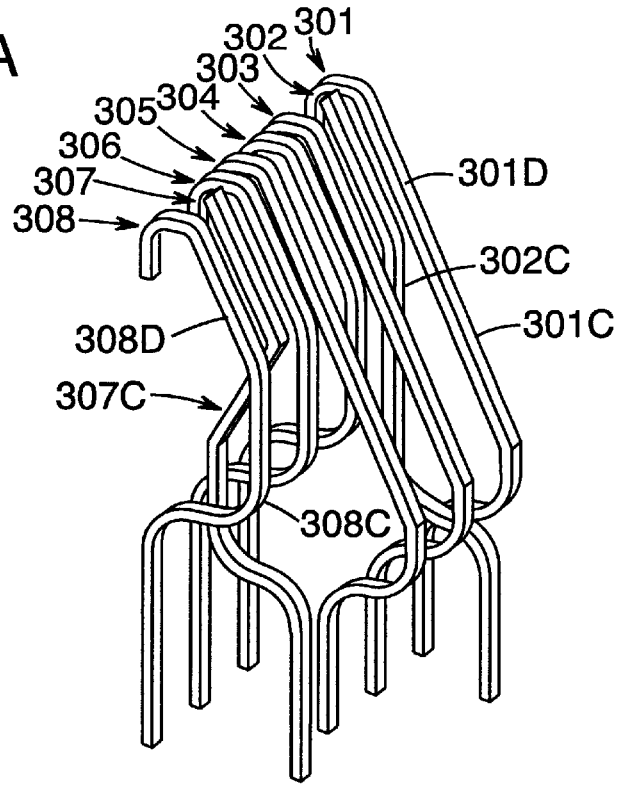
FIG. 10A is a front perspective view of all eight conductors of the jack connector of FIGS. 7A and 7B.
Figure 10B:
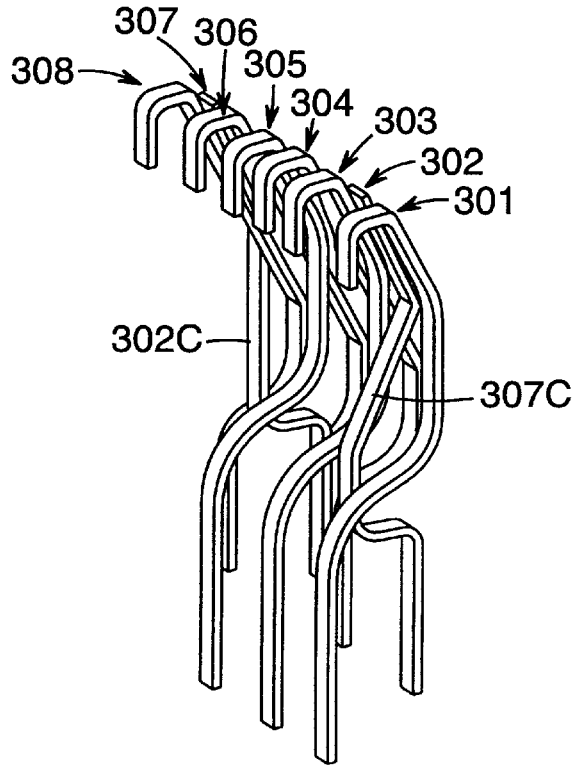
FIG. 10B is a rear perspective view of the all eight conductors of the jack connector of FIGS. 7A and 7B.

With reference to FIGS. 10A and 10B, note that the section 307C is oriented in a selected direction, which direction is not parallel to the "C" sections of the adjacent conductors 308 and 306 or to the next conductor 305. As can be observed from FIGS. 10A and 10B, preferably section 307C is not parallel to any of the other "C" sections of the conductors 301 to 308. In a preferred embodiment, section 307C is anti-parallel to section 305C and section 303C. That is, the section 307C is oriented transversely to a plane defined by sections 303C and 305C.

As can also be seen from FIGS. 10A and 10B, section 301C is parallel and coplanar with sections 302C and 305C, and section 302C is parallel to sections 304C and section 306C. However, the geometric pattern of the "C" sections of conductors 303, 304, 305, and 306 is not exactly repeated as section 302C is physically longer than sections 304C and 306C. Based on the iterative analysis above using the SPICE™ program, the above-described geometry symmetries were found to reduce the aforementioned problems of cross talk between the conductors 301 to 308.

Referring back to FIGS. 8A and 8B which includes optional capacitors disposed with the printed circuit board 222, a first capacitor is formed by planar conductive region 260A and planar conductive region 260B, and a second optional capacitor is formed by planar conductive region 264A and planar conductive region 264B. Viewing FIGS. 8A and 8B in conjunction with FIGS. 10A and 10B, the first optional capacitor is in electrical communication with conductor 306 and conductor 308 and the second optional capacitor is in electrical communication with conductor 301 and conductor 303. Thus, the capacitors C1 and C2 are defined by conductive traces 226A, 226B and 228A, 228B that are electrically provided between or interdigitated relative to the paired conductors in the circuit board or substrate. Capacitive elements disposed as described above have been found to be useful in further reducing unwanted noise generated between data pairs of the plurality of conductors 28. The use of the optional capacitive elements with the conductor structure shown in FIG. 9 is exemplary, and is discussed in part to indicate the conductors with which the optional capacitors can electrically communicate.

It will thus be seen that the invention efficiently obtains the objects set forth above, among those made apparent from the foregoing description. Because certain changes in the above constructions can be made without departing from the scope of the invention, it is intended that all matter contained in the above description and accompanying drawings be interpreted as illustrative and not in a limiting sense. For example, preferably a connector in accordance with the invention includes both capacitive and inductive elements for compensating for capacitive and inductive cross talk. However, the methods and apparatus disclosed herein can be useful in a connector that uses substantially inductive compensation or substantially capacitive compensation to address cross talk.

It is also to be understood that the following claims are intended to cover generic and specific features of the invention described herein and all statements of the scope of the invention which as a matter of language might be said to fall therebetween.

Having described the invention, what is claimed as new and to be secured by Letters Patent is:

1. A modular connector for mating with a plug connector for electrical connection therewith, comprising:

a body;

a plurality of paired and non-paired conductors disposed with the body, each of the conductors extending from a first portion to a second end and having a contact portion therebetween, said contact portions being parallel and arranged in a row for electrical connection with a row of contacts of the plug connector when mated with the modular connector, said first portions for connection with an external circuit for communication of signals between the contacts and the external circuit, said first portions being electrically spaced from said contact portions by a first electrical distance; and said contact portions lying in a plane so that the plug connector when mated with said modular connector lies in front of said plane, and a substrate lying behind said plane;

a capacitive element disposed with the substrate and in electrical communication with said second ends of non-paired conductors, said capacitive element being electrically spaced from said contact portions of the first pair of conductors by a second electrical distance that is less than said dirst electical distance.

2. The modular connector of claim 1 wherein said electrical conductors including at least four conductors, said first conductor is next to said second conductor, said second conductor is next to said third conductor, and said third conductor is next to said fourth conductor, a first section of said first conductor is parallel to a first section of said third conductor, a first section of said second conductor is parallel to a first section of said fourth conductor, and said first sections of first and third conductors are not parallel to said first sections of said second and fourth conductors, and said first sections of said four conductors are arranged in a row for providing a selected inductive coupling between at least two of said first sections that are parallel.

3. The modular connector of claim 2 wherein each of said first sections is straight.

4. The modular connector of claim 2 wherein said second and fourth conductors each include a second section, said second sections being parallel, and wherein for each conductor, said second section of that conductor forms a continuous length with the first section of that conductor, said second sections forming a row of second sections.

5. The modular connector of claim 2 wherein first and third conductors each include a second section, said second sections being parallel, and wherein for each conductor, said second section of that conductor forms a continuous length with the first section of that conductor, said second sections forming a row of second sections.

6. The modular connector of claim 5 wherein said first sections of said first and third conductors are coplanar with said second sections of said first and third conductors.

7. The modular connector of claim 5 wherein said second sections of said first and third conductors include said contact portions of said first and third conductors.

8. The modular connector of claim 7 wherein said second sections of said second and fourth conductors are coplanar with said first sections of said second and fourth conductors.

9. The modular connector of claim 7 wherein said second sections of said second and fourth conductors include said contact portions of said second and fourth conductors.

10. The modular connector of claim 1 wherein said first pair of conductors includes first and second conductors, said contact portion of said first conductor being non adjacent to said contact portion of said second conductor, and there being a single contact portion between said contact portions of said first and second conductors along said row of contact portions.

11. The modular connector of claim 10 wherein said conductors of said first pair include sections shaped for providing a selected inductive coupling therebetween for compensation of cross talk.

12. The modular connector of claim 1 wherein said two conductors of said first pair each include a respective second portion, said electrical communication with said capacitive element being established with each conductor's second portion, and wherein for each conductor of said two conductors said contact portion of that conductor is located between, as measured along the length of that conductor, said second portion of that conductor and said first portion of that conductor.

13. The modular connector of claim 12 including a substrate disposed with the modular connector, said capacitive element being disposed with said substrate.

14. The modular connector claim 12 wherein said substrate includes conductive paths in electrical communication with said capacitive element and said second portions of said two conductors of said first pair for establishing said electrical communication with said two conductors of said first pair of conductors.

15. The modular connector of claim 1 including a second capacitive element in electrical communication with a second pair of conductors, said second pair not including the conductors of said first pair of conductors.

16. The modular connector of claim 15 wherein said contact portions define first and second pairs of contact portions, wherein for each pair, one contact portion of that pair is adjacent and in between both contact portions of the other pair, and wherein said conductors of said first pair of conductors include said first pair of contact portions and said conductors of said second pair of conductors include said second pair of contact portions.

17. The modular connector of claim 1 wherein said second electrical distance is less than 5 degrees of phase at a frequency of 200 MHz.

18. The modular connector of claim 1 wherein said second electrical distance is less than 3 degrees of phase at a frequency of 200 MHz.

19. The modular connector of claim 1 wherein said contact portions define first and second pairs of contact portions, wherein for each pair, one contact portion of that pair is adjacent and in between both contact portions of the other pair, and wherein said conductors of said first pair of conductors include the contact portions of one of said pairs of contact portions.

20. The modular connector of claim 1 wherein said capacitive element is a discrete capacitor.

21. The modular connector claim 1 wherein said capacitive element includes planar conductive areas disposed with the substrate, said planar conductive areas having a portion of the substrate disposed therebetween for use as dielectric of said capacitive element.

22. The modular connector of claim 1 wherein said capacitive element includes interdigitated conductive areas disposed with said substrate.

23. The modular connector of claim 1 wherein said capacitive element includes a discrete capacitor affixed to said substrate.

24. The modular connector of claim 1 including four conductors, said first pair of conductors including two of said four conductors, and said conductors being arranged in a row such first conductor is adjacent said second conductor, said second conductor is adjacent said third conductor, and said third conductor is adjacent said fourth conductor, and for adjacent lengths along each conductor, said first and third conductors are parallel, said second and fourth conductors are parallel, and wherein said first and third conductors are not parallel to said second and fourth conductors, thereby providing a selected inductive coupling for enhancing the electrical performance when said modular connector is in electrical connection with the other modular connector.

25. A modular connector for mating with a second modular connector for electrical connection therewith, and where the second modular connector introduces cross talk having a predetermined inductive component and a predetermined capacitive component, comprising:

a body;

a plurality of paired and not paired conductors disposed with the body, each of the conductors extending from a first portion to a second end and having a contact portion therebetween, said contact portions being parallel and arranged in a row for electrical connection with a row of contacts of the second connector when mated with the second connector, said first portions for connection with an external circuit for communication of signals between the contacts and the external circuit, and a substrate behind a plane defined by the parallel contact portions;

wherein said substrate includes capacitive element connected to said second ends of non-paired conductors and disposed with said substrate, and an inductive element disposed with said connector, said capacitive and inductive elements being in electrical communication with said conductors, and wherein said capacitive element provides a capacitive compensation selected to address only the capacitive component of the cross talk said inductive element provides an inductive coupling selected to address only the inductive component of the cross talk.

26. The modular connector of claim 25 wherein said modular connector is a jack connector.

27. The modular connector of claim 26 wherein said modular connector is a jack type connector.

28. The modular connector of claim 25 wherein said first portions of said first pair of conductors are electrically spaced from said contact portions thereof by a first electrical distance, and wherein said capacitive element is electrically spaced from said contact portions of said first pair by a second electrical distance that is less than said first electrical distance.

29. The modular connector of claim 28 wherein said capacitive element is nearer electrically to said contact portions of said first pair than to said first portions of said first pair.

30. A modular connector for electrical connection with a second modular connector, the second modular connector introducing an undesirable cross talk, comprising:

a body;

a plurality of paired and non-paired conductors disposed with the body, each of the conductors extending from a first portion to a second end and having a contact portion therebetween, said contact portions being parallel and arranged in a row for electrical connection with a row of contacts of the second connector when mated with the second connector, said first portions for connection with an external circuit for communication of signals between the contacts and the external circuit, and a substrate behind a plane defined by the parallel contact portions;

wherein said substrate includes a capacitive element connected to selected non-paired conductor second ends, and an inductive element disposed with said connector, said capacitive and inductive elements being in electrical communication with said conductors, and wherein said inductive element is not interposed electrically between said capacitive element and said contact portion of said first pair of conductors.

31. A modular connector for electrical connection with a second modular connector, the second modular connector introducing an undesirable cross talk, comprising:

a body;

a first pair of conductors disposed with the body, each of the conductors extending from a first portion to a second end and having a contact portion there between, said contact portions being parallel and arranged in a row for electrical connection with a row of contacts of the second connector when mated with the second connector, said first portions for connection with an external circuit for communication of signals between the contacts and the external circuit, and a substrate behind a plane defined by the parallel contact portions;

said first pair of conductors each including a second portion, said contact portions being located electrically between said second portions and said first portions, and said substrate disposed behind a plane defined by said parallel contact portions, said substrate including a capacitive element connected to selected conductor second ends and said substrate disposed with said connector and in electrical communication with a conductor of said first pair, said electrical communication being established with said second portions of said selected conductors.

32. A method of compensating for cross talk using a first modular connector when the first modular conductor is mated with a second modular corrector that includes a plurality of parallel conductor contact portions for data pairs and that introduces cross talk, having a predetermined capacitive component and a predetermined inductive component, between the data pairs, comprising:

providing a substrate behind a plane defined by the parallel conductor contact portions;

providing a capacitive element on said substrate that provides a capacitive coupling for the conductors so selected as to address only the capacitive component of the cross talk;

providing non-parallel conductor portions to form an inductive element that provides an inductive coupling selected to address only the inductive component of the cross talk; and disposing the capacitive element with the substrate such that the capacitive element is in electrical communication with free end portions of selected conductors, the first pair of conductors being other than one of the data pairs.

33. A method of compensating for cross talk that occurs when a modular connector is electrically connected to a plug connector, the modular connector including a plurality of conductors, and the conductors having free end portions extending beyond parallel conductor contact portions for data signal pairs and comprising:

coupling a capacitive element to conductor free end portions that are not data pairs, coupling an inductive element to conductors that are not data pairs, disposing the capacitive and inductive elements at first and second electrical distances respectively from said contact portions, selecting a second electrical distance greater than said first electrical distance with said contact portions provided between said capacitive and inductive elements, and providing a substrate behind a plane defined by the parallel contact portions, and locating said capacitive element on said substrate.

34. The method according to claim 33 wherein said conductors include non parallel portions defining said inductive element that is electrically spaced from said capacitive element by an electrical distance which is defined by the sum of said first and second electrical distances.

35. The method a according to claim 34 wherein said conductors include non parallel portions defining said inductive element that is electrically spaced from said capacitive element by an electrical distance which is defined by the sum of said first and second electrical distances.

* * * * *